US007172367B2

(12) United States Patent
Jeory

(10) Patent No.: US 7,172,367 B2
(45) Date of Patent: Feb. 6, 2007

(54) INFLATABLE HOSE SYSTEM

(76) Inventor: James Jeory, 3 Abbey Walk, Penworthem, Preston, PR1 9BE (GB)

( * ) Notice: Subject to any disclaimer, the term of this patent is extended or adjusted under 35 U.S.C. 154(b) by 314 days.

(21) Appl. No.: 10/731,544

(22) Filed: Dec. 9, 2003

(65) Prior Publication Data

US 2004/0165954 A1 Aug. 26, 2004

Related U.S. Application Data

(63) Continuation of application No. PCT/GB01/02555, filed on Jun. 13, 2001.

(51) Int. Cl.
*E02B 15/06* (2006.01)

(52) U.S. Cl. ..... 405/70; 405/68; 405/63

(58) Field of Classification Search ..... 405/63, 405/68, 70

See application file for complete search history.

(56) References Cited

U.S. PATENT DOCUMENTS 3,050,750 A * 8/1962 Harrison ..... 405/63
4,652,173 A 3/1987 Kallestad
5,149,226 A * 9/1992 Antinoro et al. ..... 405/63
5,190,402 A * 3/1993 Vick ..... 405/70
5,197,821 A 3/1993 Cain et al.
5,238,327 A * 8/1993 Blair et al. ..... 405/68
5,522,674 A * 6/1996 Cooper ..... 405/63

FOREIGN PATENT DOCUMENTS

DE 2136619 2/1972
DE 4313438 2/1994

* cited by examiner

*Primary Examiner*—Frederick L. Lagman
(74) *Attorney, Agent, or Firm*—Gauthier & Connors LLP

(57) ABSTRACT

An inflatable hose system which may act as a boom for rescue purposes or for controlling the flow of surface borne contaminants of rivers, lakes and seas and comprising first and second hose lengths each having one en flattened and sealed to be chiselshaped and the other end provided with a coupling. The two lengths and any interposing standard hose lengths may thus be coupled together and inflated to a pressure in the range of 2 to 3.5 bar to provide a boom of the required length, and one of the hose lengths includes an inflation valve. The hose length may be connected together in mutual alignment thus to produce a straight boom or with the interposition of elbows to form a curved boom capable of containing floating objects or substances.

14 Claims, 2 Drawing Sheets

INFLATABLE HOSE SYSTEM

This is a continuation of International Application PCT/GB01/02555 filed on Jun. 13, 2001 and which designated the U.S.

THIS INVENTION concerns an inflatable hose system which may act as a boom for rescue purposes or for controlling the flow of surface borne contaminants of rivers, lakes and seas.

The system is particularly useful to fire services for example when rescuing personnel or animals trapped across a river or other body of water where a rescue device must be deployed rapidly, particularly when no boat is readily available.

It has been found that a flexible hose, such as a fire hose, if inflated to a pressure of 2 or 3 bar becomes rigid and can be directed across the surface of water without submerging.

It is an object of the present invention to provide an inflatable hose system which is lightweight and portable and can be readily deployed utilising several sections of hose coupled together in an airtight manner.

Thus, an inflatable hose system, according to the invention, comprises first and second hose lengths adapted to be detachably coupled together, and end-sealed thus to be inflatable, and including an inflation valve connected to at least one of the first and second hose lengths.

Preferably, the system comprises two short lengths of hose each having one end. flattened and sealed and at the other, one part of a two-part coupling whereby the two hose lengths may be coupled together with or without the interposition of one or more additional lengths of standard hose.

The inflation valve is preferably mounted in the wall of one of the hose lengths.

Preferably, each flattened and sealed end is plated and includes means for attachment thereto of a line or shackle.

Preferably, the flattened ends are sealed using a bonding agent and then vulcanised, a pair of opposed stainless steel plates being bolted together through the flattened and vulcanised hose end.

One or more of the couplings may have a butterfly or ball valve to enable the associated hose length to be sealed after inflation whereby the other hose length, and additional hose lengths, may be connected thereto when the hose length is inflated.

An embodiment of the invention, will now be described, by way of example only, with reference to the accompanying drawings, in which.

Figure 3:
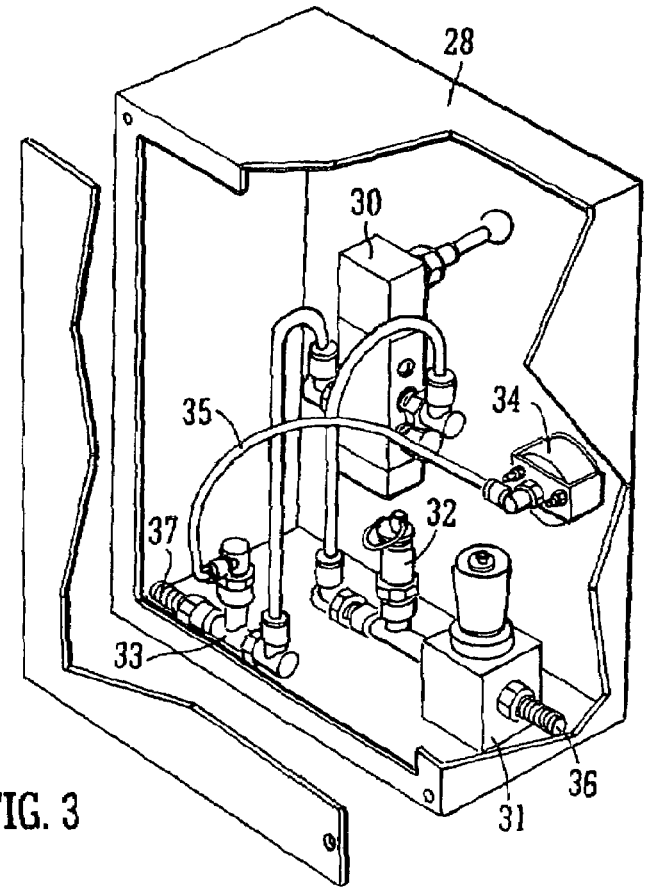

and FIG. 3 is an isometric view of an inflation unit for the system.

Referring now the drawings, the system comprises two short lengths 10 and 11 of typical fire hose each flattened at one end 12 and sealed as will be described prior to plating with opposed reinforcing plates 13 and 14 which may be of plastics, e.g. nylon, or an alloy or stainless steel and bolted together through the sealed and flattened end of the hose.

At the other end of each hose length is one part of a two-part coupling 15, 16. This is a standard coupling of the type which is watertight and, in this case, airtight up to a pressure of something in the region of 7 bar.

An inflation valve 20 is attached to the wall of hose length 10 and comprises an inner sleeve 21 and an outer sleeve 22 threadedly connected together, the inner sleeve having a spigot 23 which passes through an aperture in the hose wall.

A clamping washer 24 is interposed between the inner and outer sleeves and has an annular protrusion 25 which together with a corresponding annular groove 26 in the inner sleeve 21 serve to trap the wall of the hose in such a manner that no leakage can occur. An elbow connector 27 is threadedly engaged within the bore of inner sleeve 21. The outer end of the elbow connector 27 includes a one-way pressure relief valve (not shown).

Thus, it will be seen, that by connecting together the two hose lengths 10 and 11 preferably with an appropriate length of standard hose between them and by inflating the entire assembly to a pressure of, for example, 3 bar, the hose becomes rigid and acts like a boom which can then be deployed across the surface of a body of water to provide access to a remote position across the water.

The provision of the flattened "chisel" end of the system ensures that the hose will ride across the surface of the water easily and rapidly without submerging.

If required, one or both parts of the coupling may include a butterfly or ball valve whereby it can be closed after inflation to enable additional lengths of hose to be added.

It will be seen that the plates 13 may have rope or shackle location eyes for attachment to an object to be projected or drawn across the water.

A boom created by adding lengths of hose to the inflatable hose system may be used for controlling the passage of floating contaminants such as oil, and may be located or suspended between the stantions of an arched bridge to catch objects or substances floating downstream.

The device has considerable rescue capabilities and, for example, in a fast flowing river it can be dropped into the water and held at one end on the near bank such that the other end will swing across the river to be anchored on the far bank.

By incorporating 45° or 90° elbow connectors, the system may be assembled to form an angular or generally curved boom, which may be a closed loop, thus to enclose objects or substances and prevent them from being swept away in any direction.

The flattened ends of the hose lengths are formed by the use of a bonding agent and then vulcanised for example at 25° C. for a period of 10 minutes after which the flattened end may be drilled and plated as illustrated.

Referring now to FIG. 3 the system may be supplied with its own inflation unit 28 which may be preset and adapted to inflate the system to the anticipated suitable working pressure of 3 bar, and to permit safe deflation when required. The unit comprises a control valve 30 connected between an inlet assembly comprising a pressure regulator 31 and a pressure relief valve 32, and an outlet assembly comprising an outlet connector 33 preferably having a pressure gauge 34 connected by a pipe 35 to the outlet connector.

Typically, a gas cylinder of the type used by fire services for supplying air to breathing apparatus, is capable of inflating the system including eight lengths of 70 mm hose each of 23 metres in length, and such a cylinder is adapted for attachment to the inlet assembly of the inflation unit by way of a bulkhead adaptor 36. The outlet connector 33 has a bulkhead adaptor 37 for connection to the inflation valve 20 of the inflatable hose system.

The inflation unit is conveniently contained within a housing 28, and the unit together with the pair of inflation hoses 10 and 11 are compact and easily stowed during storage and transportation.

In practice, an inflatable hose system in accordance with the invention will remain serviceable for 24 hours or more, depending upon the condition of the delivery hoses and the instantaneous couplings, and the assembly is easily topped up by reconnection to the inflation unit 28.

The control valve 30 in the inflation unit has an operational position which is selectable to effect safe deflation of the hose system when connected thereto.

With the inflation unit preset to deliver 3 bar pressure, the pressure relief valve is ideally set to operate if the pressure exceeds 3.5 bar.

Figure 1:
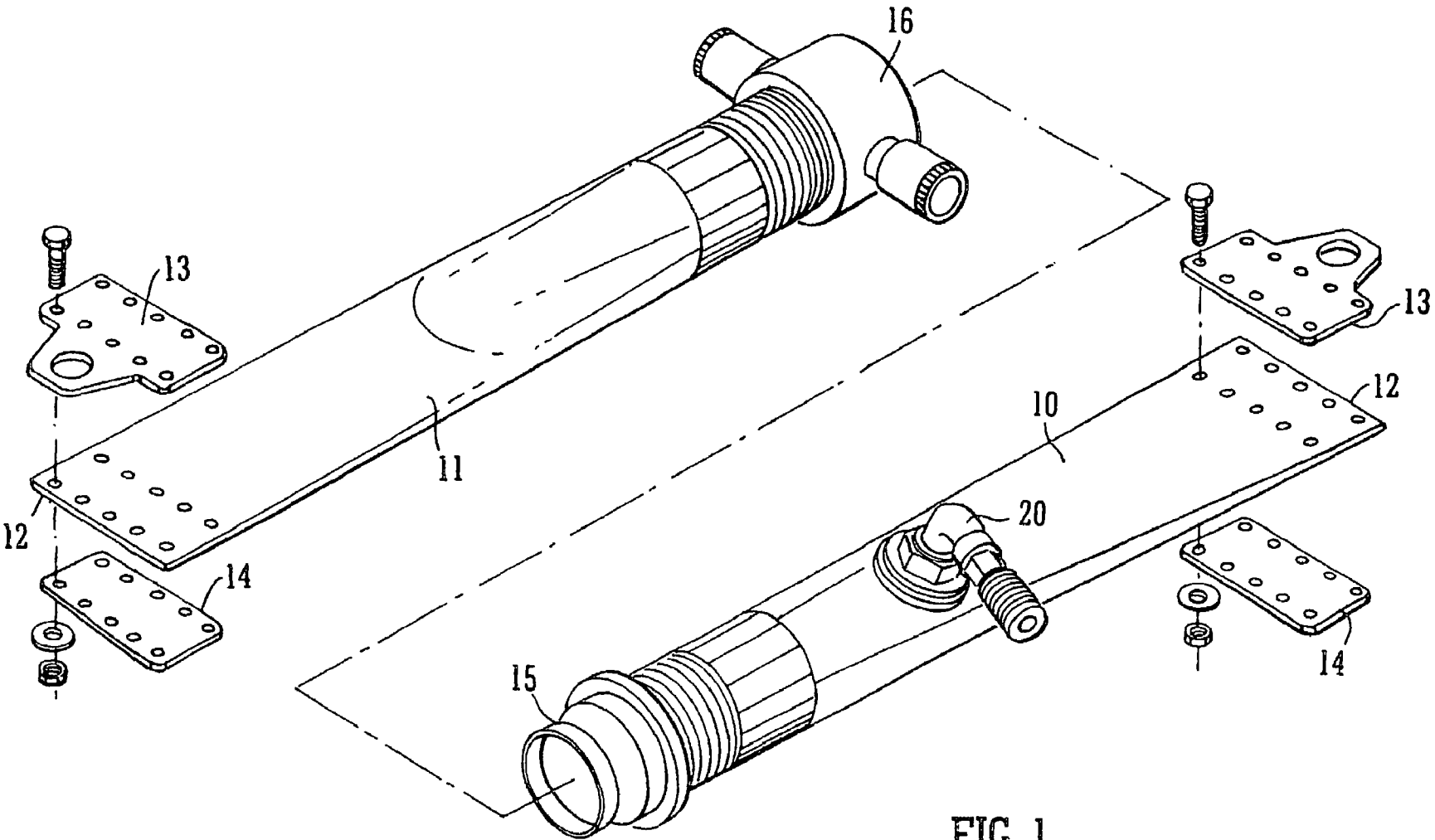
FIG. 1 is isometric view of an inflatable hose system constructed in accordance with the invention.
Figure 2:
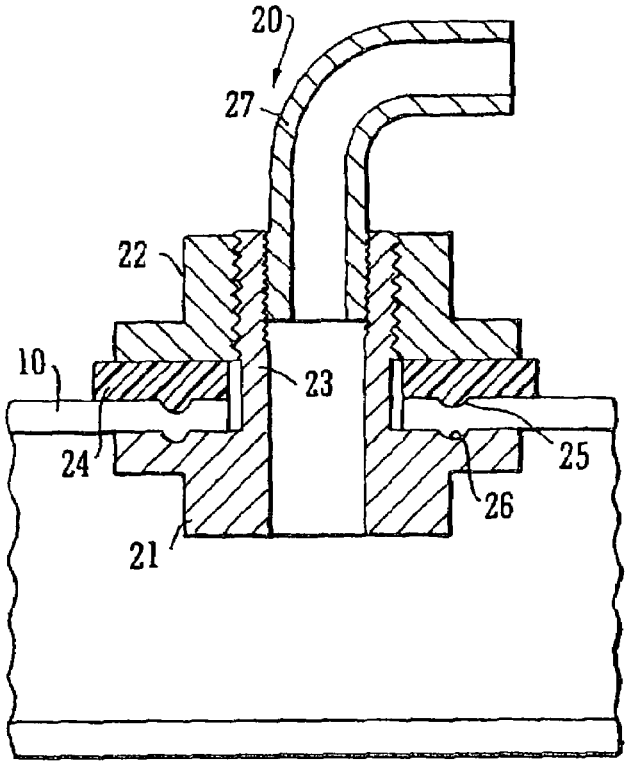
FIG. 2 is a cross-section through an inflation valve in one part of the system.

It is a matter of appreciable convenience to fire services for an inflatable hose system of this kind to be compact and readily portable and it is envisaged that each hose length as illustrated in FIG. 1 need only be in the region of 30 to 60 cm in length, the remainder of the system then being assembled using selected lengths of standard hose. This renders the entire system readily accommodated on a typical fire tender where space is at a premium.

The invention is not limited to the details described herein. For example, the hose couplings may be arranged such that the lengths are other than aligned and may include, for example, T-shaped couplings to enable two or more booms to be fed from one inflation valve. Also, the inflation valve may be incorporated into the coupling instead of through the hose wall.

Many variations and attachments may be applied to the system according to the purpose for which it is required.

The invention claimed is:

1. An inflatable hose system comprising first and second hose lengths each having opposed ends comprising a first flattened and sealed end and a second end provided with one part of a two part coupling, such that the two hose lengths may be detachably coupled together with or without the interposition of one or more additional lengths of standard hose to form an airtight continuous hose for use as a rigid floatable boom, and an inflation valve connected to at least one of the first and second hose lengths thus to enable inflation of said airtight continuous hose.

2. An inflatable hose system according to claim 1, wherein the inflation valve is mounted in the wall of one of the hose lengths.

3. An inflatable hose system according to claim 1, wherein each flattened and sealed end includes a superimposed rigid plate and includes means for attachment thereto of a line or shackle.

4. An inflatable hose system according to claim 1, wherein the or each flattened end is sealed with a bonding agent and is vulcanised, with a pair of opposed plates bolted together through the flattened and vulcanised hose end.

5. An inflatable hose system according to claim 1, wherein the or each coupling part includes a valve to enable the associated hose length to be sealed after inflation.

6. An inflatable hose system according to claim 1, wherein the inflation valve comprises an inner sleeve and an outer sleeve threadedly connected together, the inner sleeve having a spigot which passes through an aperture in the hose wall, and a clamping washer being interposed between the inner and outer sleeves and having annular protrusions which serve to trap the wall of the hose between the inner and outer sleeves.

7. An inflatable hose system according to claim 6, including an elbow connector threadedly engaged within a bore of the inner sleeve and including a one-way pressure relief valve.

8. An inflatable hose system according to claim 1, including an inflation unit comprising a pressure regulator, a pressure relief valve and selectable valve means to permit deflation of said airtight continuous hose.

9. An inflation unit according to claim 8, wherein the pressure regulator is adapted to inflate the hose system to a pressure in the range 2 to 3.5 bar.

10. A method of producing a rigid floatable boom comprising the steps of providing an inflatable hose system comprising first and second hose lengths each having opposed ends comprising a first flattened and sealed end and a second end provided with one part of a two-part coupling, detachably coupling said hose lengths together, with or without the interposition of one ore more additional lengths of standard hose, to form an airtight continuous hose and inflating said airtight continuous hose through an inflation valve connected to at least one of the first and second hose lengths to form said rigid floatable boom.

11. A method according to claim 10, wherein the sealed end of at least one of the hose lengths is flattened to become chisel-shaped whereby the hose will ride across the surface of a body of water easily and rapidly without submerging.

12. A method according to claim 10, including the step of interposing one or more further lengths of standard hose between the first and second hose lengths thus to extend the length of the airtight continuous hose.

13. A method according to claim 12, wherein one or each of said coupling parts includes a valve to enable the associated hose length to be sealed and to thus to enable the attachment of the or each further length of standard hose to the hose length associated with the said valve after inflation thereof.

14. A method according to claim 10, wherein the coupled hose lengths are inflated to a pressure in the range of 2 to 3.5 bar.

* * * * *